US006769401B2

(12) United States Patent
Tachibana et al.

(10) Patent No.: US 6,769,401 B2
(45) Date of Patent: Aug. 3, 2004

(54) POWER OUTPUT CONTROL SYSTEM FOR INTERNAL COMBUSTION ENGINE

(75) Inventors: Yosuke Tachibana, Saitama-ken (JP); Norio Suzuki, Saitama-ken (JP); Manabu Niki, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 62 days.

(21) Appl. No.: 10/300,480

(22) Filed: Nov. 20, 2002

(65) Prior Publication Data

US 2003/0094157 A1 May 22, 2003

(51) Int. Cl.[7] ..... F02P 5/15

(52) U.S. Cl. ..... 123/406.13; 123/406.52; 123/398; 701/107

(58) Field of Search ..... 123/396, 397, 123/398, 406.13, 406.52; 701/107, 105

(56) References Cited

U.S. PATENT DOCUMENTS 5,339,782 A * 8/1994 Golzer et al. ..... 123/399
5,492,097 A * 2/1996 Byram et al. ..... 123/396
5,601,063 A * 2/1997 Ohashi et al. ..... 123/396
5,992,379 A * 11/1999 Brudigam et al. ..... 123/339.1
6,230,094 B1 * 5/2001 Ohashi et al. ..... 701/107
6,267,099 B1 * 7/2001 Yamada et al. ..... 123/396
6,488,007 B2 * 12/2002 Satou et al. ..... 123/396

* cited by examiner

*Primary Examiner*—Mahmoud Gimie
*Assistant Examiner*—Arnold Castro
(74) *Attorney, Agent, or Firm*—Lahive & Cockfield, LLP; Anthony A. Laurentano

(57) ABSTRACT

There is provided a power output control system for an internal combustion engine, which enables the vehicle to smoothly perform refuge travel to find a place to park when an electric throttle control device becomes incapable of controlling a throttle valve, while ensuring adequate traveling performance. An ECU determines whether or not the electric throttle control device is incapable of controlling the throttle valve, and interrupts energization of the electric throttle control device when it is determined that the electric throttle control device is incapable of controlling the throttle valve. At this time, the opening of the throttle valve is held at the default opening degree by a spring. Further, basic ignition timing is calculated according to the engine rotational speed and load on the engine, and ignition timing of the engine is determined by correcting the calculated basic ignition timing according to the amount of operation of the accelerator pedal.

8 Claims, 4 Drawing Sheets

POWER OUTPUT CONTROL SYSTEM FOR INTERNAL COMBUSTION ENGINE

BACKGROUND OF THE INVENTION

1. Field of the Invention

This invention relates to a power output control system for an internal combustion engine including an electric throttle control device for electrically controlling a throttle valve, and more particularly to a power output control system for controlling the power output of the engine when the electric throttle control device is in a condition incapable of controlling the throttle valve.

2. Description of the Prior Art

Conventionally, a power output control system of the above-mentioned kind has been disclosed e.g. in Japanese Laid-Open Patent Publication No. 11-22530. According to the power output control system, when a throttle valve has become uncontrollable e.g. due to an electrical or mechanical failure of an electric throttle control device, the electric throttle control device is deenergized, and at the same time the degree of opening of the throttle valve is held at a default opening degree so as to avoid an engine stall and allow the vehicle to travel to find a nearby place to park.

Further, the power output control system is configured such that when the accelerator pedal is not stepped on at all or completely released, the torque generated by the engine is reduced to an amount corresponding to an idle engine rotational speed by correction of the air-fuel ratio of a mixture and the ignition timing, and when the accelerator pedal is stepped on from the released state, the rotational speed of the engine is increased to thereby prevent degradation of drivability.

As described above, according to this power output control system, when the throttle valve becomes uncontrollable due to failure of the electric throttle control device, if the accelerator pedal has been stepped on, i.e. the vehicle is actually traveling to find a nearby place to park (hereinafter, this travel carried out in case of uncontrollability of the throttle valve will be referred to as "refuge running"), the degree of opening of the throttle valve is held in the default opening degree which makes the rotational speed of the engine slightly higher than the idle engine rotational speed. Therefore, it is impossible to secure a sufficient amount of intake air when the vehicle is performing refuge running, and although the refuge running is possible, the vehicle cannot attain adequate traveling performance.

SUMMARY OF THE INVENTION

It is an object of the invention to provide a power output control system for an internal combustion engine, which enables the vehicle to smoothly perform refuge running while ensuring adequate traveling performance, when an electric throttle control device becomes incapable of controlling a throttle valve.

To attain the above object, according to a first aspect of the present invention, there is provided a power output control system for an internal combustion engine including an electric throttle control device for electrically controlling a throttle valve that controls an amount of intake air to be supplied to the engine, and an accelerator pedal, the power output control system comprising:

uncontrollability-determining means for determining whether or not the electric throttle control device is in a condition incapable of controlling the throttle valve;

energization-interrupting means for interrupting energization of the electric throttle control device when it is determined by the uncontrollability-determining means that the electric throttle control device is in the condition incapable of controlling the throttle valve;

default opening-holding means for holding a degree of opening of the throttle valve at a default opening degree when the electric throttle control device is determined to be in the condition incapable of controlling the throttle valve;

rotational speed-detecting means for detecting a rotational speed of the engine;

load-detecting means for detecting load on the engine;

basic ignition timing-calculating means for calculating basic ignition timing according to the rotational speed detected by the rotational speed-detecting means and the load on the engine detected by the load-detecting means;

accelerator pedal operation amount-detecting means for detecting an amount of operation of the accelerator pedal; and ignition timing-determining means for determining ignition timing of the engine by correcting the basic ignition timing according to the detected amount of operation of the accelerator pedal when the electric throttle control device is determined to be in the condition incapable of controlling the throttle valve.

According to this power output control system, when it is determined that the electric throttle control device is incapable of controlling the throttle valve, first, energization of the electric throttle control device is interrupted to stop control of the throttle valve by the electric throttle control device. At the same time, the degree of opening of the throttle valve is held at the default opening degree by the default opening-holding means to supply intake air in an amount enabling the vehicle to perform refuge running, i.e. to find a nearby place to park. Further, ignition timing of the engine is determined by the ignition timing-determining means by correcting basic ignition timing calculated based on the rotational speed of the engine and load on the same by the basic ignition timing-calculating means, according to the accelerator pedal opening.

Therefore, when the electric throttle control device is determined to be incapable of controlling the throttle valve, the basic ignition timing is corrected according to the amount of operation of the throttle valve to thereby determine the ignition timing. This makes it possible to obtain the power output of the engine according to the amount of operation of the throttle valve, i.e. driver's demand, which enables the vehicle to smoothly perform the refuge running. As a result, the default opening degree of the throttle valve can be configured to be larger than in the case of the conventional power output control system, thereby ensuring adequate traveling performance of the vehicle during the refuge running.

Preferably, the ignition timing-determining means determines the ignition timing by correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

To attain the above object, according to a second aspect of the invention, there is provided a power output control system for an internal combustion engine including an electric throttle control device for electrically controlling a throttle valve that controls an amount of intake air to be supplied to the engine, and an accelerator pedal, the power output control system comprising:

an uncontrollability-determining module for determining whether or not the electric throttle control device is in a condition incapable of controlling the throttle valve;

an energization-interrupting module for interrupting energization of the electric throttle control device when it is determined by the uncontrollability-determining module that the electric throttle control device is in the condition incapable of controlling the throttle valve;

a default opening-holding module for holding a degree of opening of the throttle valve at a default opening degree when the electric throttle control device is determined to be in the condition incapable of controlling the throttle valve;

a rotational speed-detecting module for detecting a rotational speed of the engine;

a load-detecting module for detecting load on the engine;

a basic ignition timing-calculating module for calculating basic ignition timing according to the rotational speed detected by the rotational speed-detecting module and the load on the engine detected by the load-detecting means;

an accelerator pedal operation amount-detecting module for detecting an amount of operation of the accelerator pedal; and an ignition timing-determining module for determining ignition timing of the engine by correcting the basic ignition timing according to the detected amount of operation of the accelerator pedal when the electric throttle control device is determined to be in the condition incapable of controlling the throttle valve.

According to the second aspect of the invention, the same advantageous effects as provided by the first aspect of the invention can be obtained.

Preferably, the ignition timing-determining module determines the ignition timing by correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

To attain the above object, according to a third aspect of the invention, there is provided a power output control method for controlling power output of an internal combustion engine including an electric throttle control device for electrically controlling a throttle valve that controls an amount of intake air to be supplied to the engine, and an accelerator pedal, the power output control method comprising the steps of:

determining whether or not the electric throttle control device is in a condition incapable of controlling the throttle valve;

interrupting energization of the electric throttle control device when it is determined that the electric throttle control device is in the condition incapable of controlling the throttle valve;

holding a degree of opening of the throttle valve at a default opening degree when the electric throttle control device is determined to be in the condition incapable of controlling the throttle valve;

detecting a rotational speed of the engine;

detecting load on the engine;

calculating basic ignition timing according to the detected rotational speed and the detected load on the engine;

detecting an amount of operation of the accelerator pedal; and determining ignition timing of the engine by correcting the basic ignition timing according to the detected amount of operation of the accelerator pedal when the electric throttle control device is determined to be in the condition incapable of controlling the throttle valve.

According to the third aspect of the invention, the same advantageous effects as provided by the first aspect of the invention can be obtained.

Preferably, the step of determining the ignition timing includes correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

To attain the above object, according to a fourth aspect of the invention, there is provided an engine control unit including a control program for causing a computer to control power output of an internal combustion engine including an electric throttle control device for electrically controlling a throttle valve that controls an amount of intake air to be supplied to the engine, and an acceleration pedal, wherein the control program causes the computer to determine whether or not the electric throttle control device is in a condition incapable of controlling the throttle valve, interrupt energization of the electric throttle control device when it is determined that the electric throttle control device is in the condition incapable of controlling the throttle valve, hold a degree of opening of the throttle valve at a default opening degree when the electric throttle control device is determined to be in the condition incapable of controlling the throttle valve, detect a rotational speed of the engine, detect load on the engine, calculate basic ignition timing according to the detected rotational speed and the detected load on the engine, detect an amount of operation of the accelerator pedal, and determine ignition timing of the engine by correcting the basic ignition timing according to the detected amount of operation of the accelerator pedal when the electric throttle control device is determined to be in the condition incapable of controlling the throttle valve.

According to the fourth aspect of the invention, the same advantageous effects as provided by the first aspect of the invention can be obtained.

Preferably, when the program causes the computer to correct the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

The above and other objects, features, and advantages of the invention will become more apparent from the following detailed description taken in conjunction with the accompanying drawings.

DETAILED DESCRIPTION OF A PREFERRED EMBODIMENT

Figure 1:
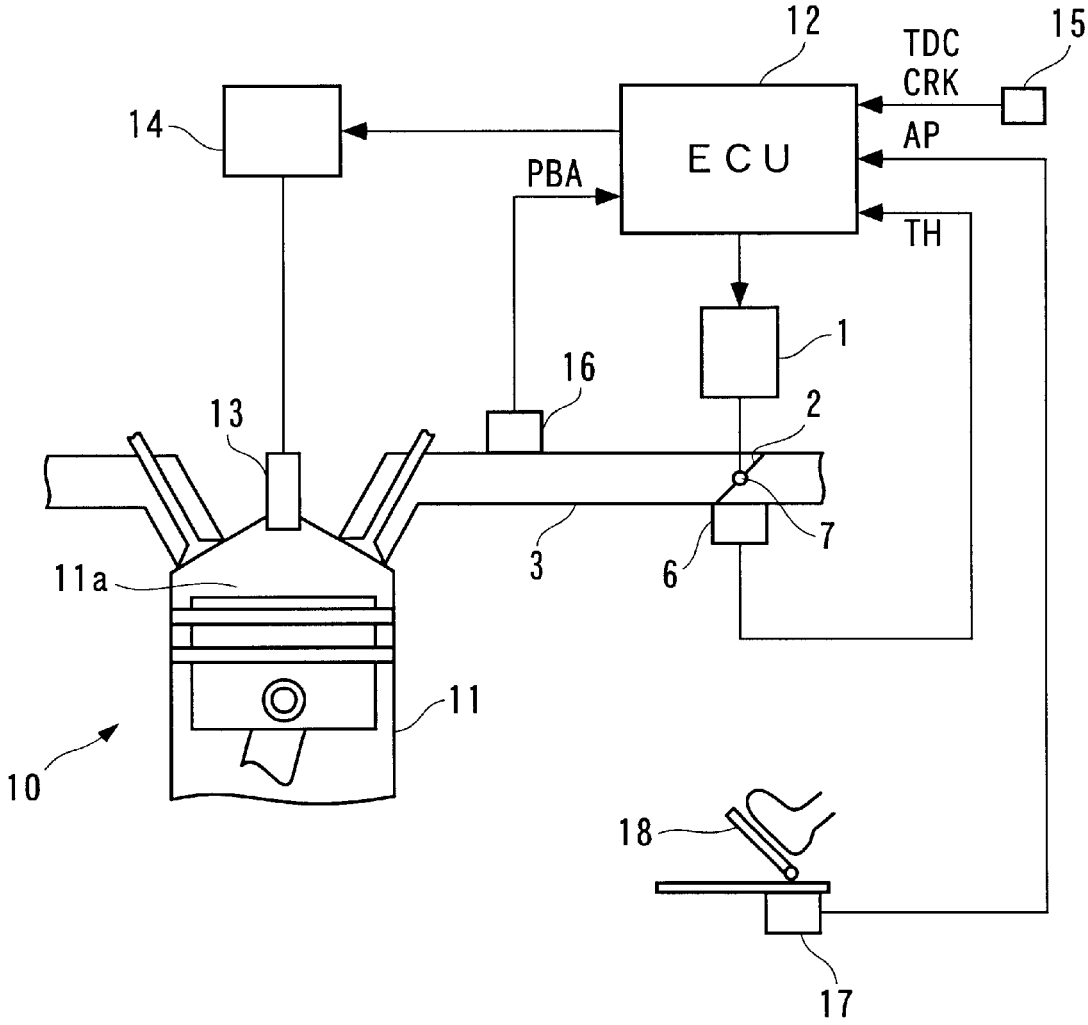
FIG. 1 is a diagram schematically showing the arrangement of a power output control system for an internal combustion engine, according to an embodiment of the present invention.
Figure 2:
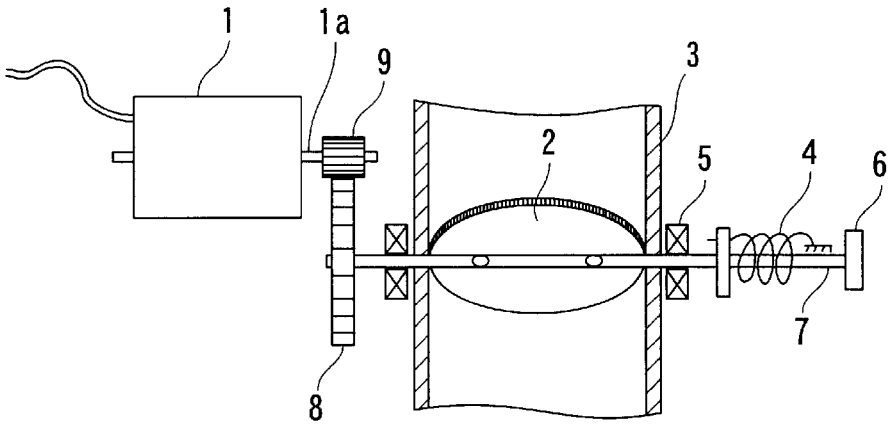
FIG. 2 is an enlarged partial cross-sectional view of an electric throttle control device.

The invention will now be described in detail with reference to the drawings showing a preferred embodiment thereof. FIG. 1 is a diagram schematically showing the arrangement of a power output control system for an internal combustion engine, to which the present invention is applied, while FIG. 2 is an enlarged partial cross-sectional view of an electric throttle control device.

As shown in the figures, an internal combustion engine (hereinafter referred to as "the engine") 10 has an intake pipe 3 connected to cylinders 11, and the intake pipe 3 has a throttle valve 2 arranged therein for controlling the amount of intake air to be supplied to a combustion chamber 11*a* of each cylinder 11. The throttle valve 2 is mounted in the intake pipe 3 such that it can pivotally move on a drive shaft 7 integrally formed with the throttle valve 2 and supported on bearings 5. Connected to one end of the drive shaft 7 is an output shaft 1*a* of a DC motor 1 via reduction gears 8 and 9. The DC motor 1 is electrically connected to an ECU 12 and has its operation controlled by the same. In short, in the present embodiment, the electric throttle control device is comprised of the DC motor 1, the reduction gears 8, 9, and the ECU 12.

A spring 4 (default opening-holding means) is attached to the other end of the drive shaft 7, for holding a degree TH of opening of the throttle valve 2 (hereinafter referred to as "the throttle valve opening TH") at a predetermined default opening degree. When the throttle valve 2 is held at the default opening degree, intake air is supplied to the combustion chamber 11*a* in an amount corresponding to an engine rotational speed which enables the vehicle to perform the refuge running at a speed of 50 km/h at the highest, for instance. Further, attached to the other end of the drive shaft 7 is a throttle valve opening sensor 6 which detects the throttle valve opening TH to deliver a signal indicative of the sensed throttle valve opening TH to the ECU 12.

The cylinder 11 of the engine 10 has a spark plug 13 inserted therein which is connected to the ECU 12 via a distributor 14. The spark plug 13 has a high voltage applied thereto in timing corresponding to the ignition timing θig by a drive signal from the ECU 12, and subsequent interruption of the application of the high voltage causes a spark discharge to ignite the mixture within the combustion chamber 11*a*.

The engine 10 has a crank angle position sensor 15 (rotational speed-detecting means) arranged around a crankshaft, not shown, which is connected to the ECU 12. The crank angle position sensor 5 is comprised of a magnet rotor and an MRE (magnetic resistance element) pickup (none of which is shown), and generates pulse signals whenever the crankshaft rotates through respective predetermined angles. More specifically, the crank angle sensor 15 generates a TDC signal whose pulse is generated at a predetermined crank angle position of each cylinder in the vicinity of a TDC (top dead center) position at the start of an intake stroke of a piston, not shown, in the cylinder, and delivers the pulse to the ECU 12. Further, the crank angle sensor 15 generates a CRK signal whose pulse is generated at a repetition period shorter than that of the TDC signal (e.g. whenever the crankshaft rotates through 30 degrees), and delivers the pulse to the ECU 12. Then, the ECU 12 calculates the rotational speed of the engine (hereinafter referred to as the "engine rotational speed" NE based on the CRK signal.

The intake pipe 3 has an intake pipe absolute pressure sensor 16 (load-detecting means) 16 inserted therein at a location downstream of the throttle valve 2. The intake pipe absolute pressure sensor 16, which is formed e.g. by a semiconductor pressure sensor, detects the absolute pressure PBA in the intake pipe 3 (intake pipe absolute pressure PBA) and delivers a signal indicative of the detected intake pipe absolute pressure PBA to the ECU 12.

Further, an accelerator pedal opening sensor 17 detects an amount of operation, i.e. a depression amount (hereinafter referred to as "the accelerator pedal opening") AP of an accelerator pedal 18 operated by the driver and delivers a signal indicative of the detected accelerator pedal opening AP to the ECU 12.

In the present invention, the ECU 12 forms uncontrollability-determining means, energization-interrupting means, basic ignition timing-calculating means, and ignition timing-determining means. The ECU 12 is implemented by a microcomputer comprised of a CPU, a ROM, a RAM, and an input/output interface (none of which is shown). The ECU 12 determines based on the signals detected by the above-mentioned sensors whether or not the electric throttle control device is in a condition incapable of controlling the throttle valve 2, and interrupts energization of the electronic throttle control device depending on the result of the determination. Further, based on the result of the determination and the accelerator pedal opening AP, the ECU 12 calculates the ignition timing θig, and delivers a drive signal based on the result of the calculation to the distributor 14.

Figure 3:
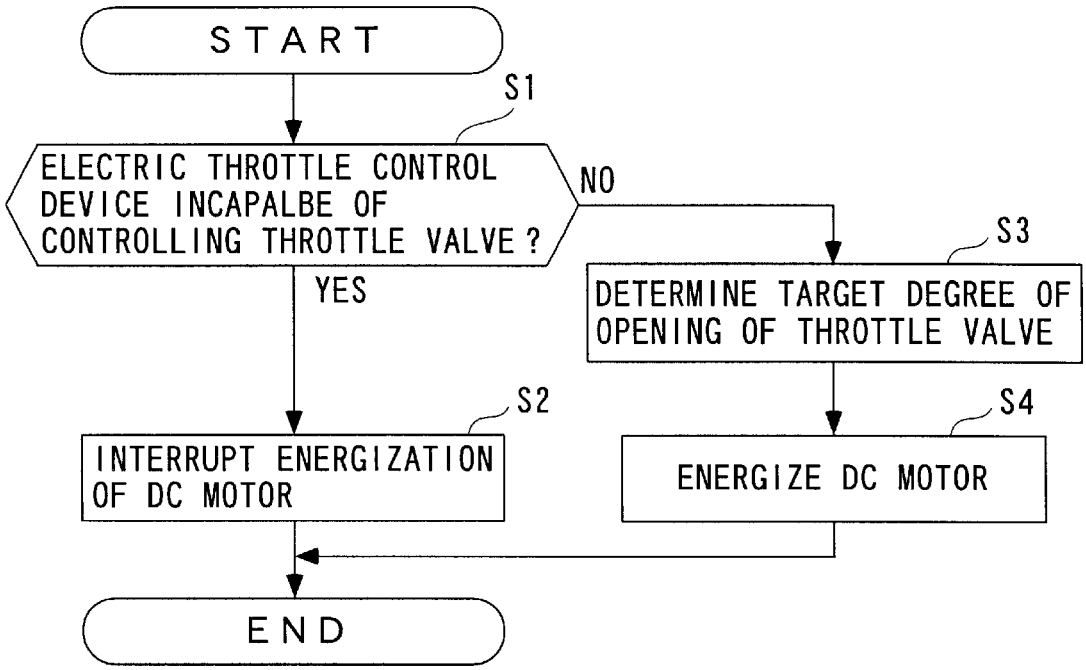
FIG. 3 is a flowchart of a control process for controlling the electric throttle control device.

FIG. 3 is a flowchart of a control process for controlling the electric throttle control device. This process is repeatedly executed by the ECU 12 at predetermined time intervals.

First, it is determined in a step S1 whether or not the electric throttle control device is in the condition incapable of controlling the throttle valve 2. In this step, e.g. when a state in which the difference between a target degree of opening of the throttle valve 2 and a detected actual throttle valve opening TH has continued to be equal to or larger than a predetermined value for a predetermined time period or longer, it is determined that the electric throttle control device is incapable of controlling the throttle valve 2. If the electric throttle control device is determined to be incapable of controlling the throttle valve 2, energization of the DC motor 1 is stopped in a step S2, followed by terminating the program. On the other hand, if the electric throttle control device is determined to be capable of controlling the throttle valve 2 in the step S1, the program proceeds to a step S3, wherein the target degree of opening of the throttle valve 2 is determined according to a detected accelerator pedal opening AP and other parameters. Then, a control signal generated based on the target degree of opening determined in the step S3 is supplied to the DC motor 1 (i.e. the DC motor is energized), followed by terminating the program.

Figure 4:
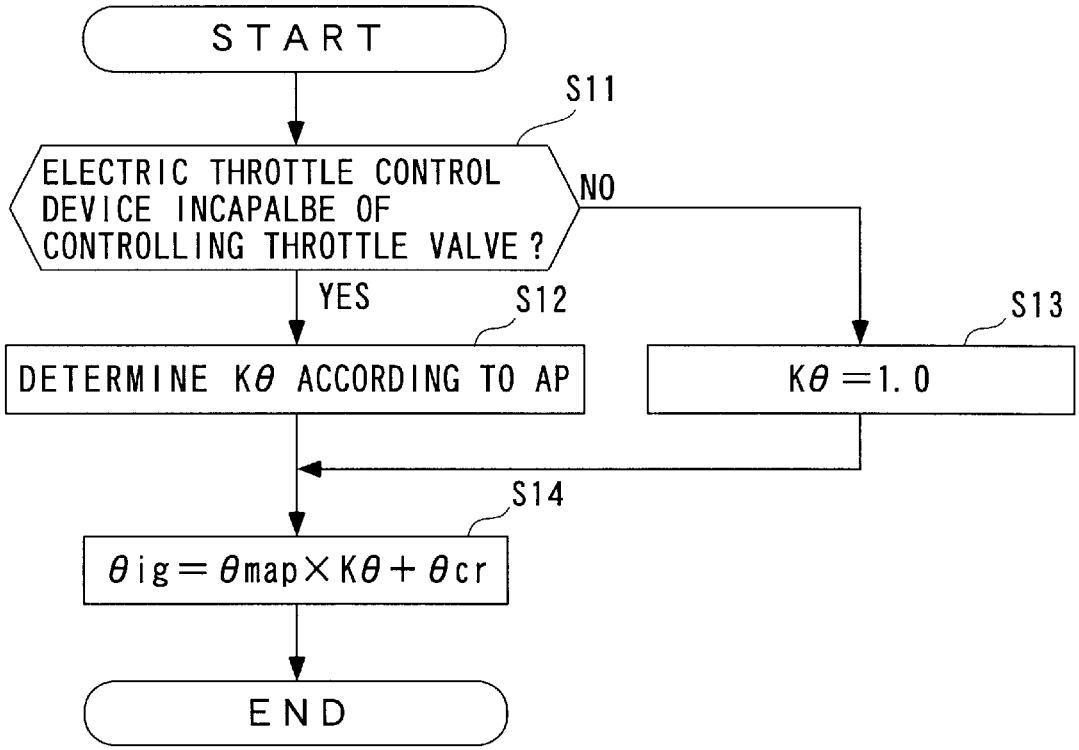
FIG. 4 is a flowchart of a power output control process for controlling the power output of the engine when the electric throttle control device is incapable of controlling a throttle valve.

FIG. 4 is a flowchart of a power output control process for controlling the power output of the engine 10 by the ignition timing, when the electric throttle control device is incapable of controlling the throttle valve 2. This process is repeatedly executed by the ECU 12 in synchronism with generation of each pulse of the TDC signal.

Figure 5:
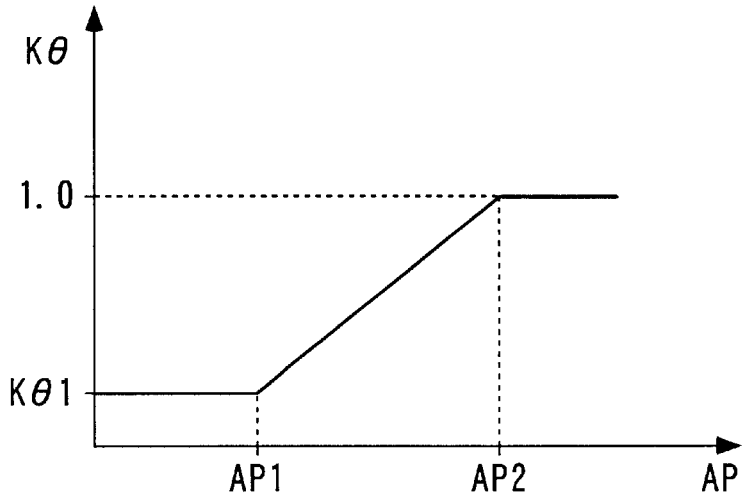
FIG. 5 is a diagram showing an example of a table for use in setting an ignition timing correction coefficient according to an accelerator pedal opening.

First, in a step S11, similarly to the step S1 in FIG. 3, it is determined whether or not the electric throttle control device is in the condition incapable of controlling the throttle valve 2. If the electric throttle control device is determined to be incapable of controlling the throttle valve 2, a correction coefficient Kθ is set according to the accelerator pedal opening AP in a step S12. The correction coefficient Kθ is used to multiply a basic ignition timing θmap, referred to hereinafter, and has a value which is equal to or smaller than 1.0 and set according to the accelerator pedal opening AP. FIG. 5 shows an example of a table for use in setting the correction coefficient Kθ. According to this table, the correction coefficient Kθ is set to a predetermined value Kθ1 (e.g. 0.3) when the accelerator pedal opening AP is equal to or smaller than a first predetermined value AP1 (e.g. 10 degrees), and set to 1.0 when the accelerator pedal opening AP is larger than a second predetermined value AP2 (e.g. 30 degrees) larger than the first predetermined value AP1. When the accelerator pedal opening AP is between the first and second predetermined values AP1, AP2, the correction coefficient Kθ is set to a linearly larger value as the AP value is larger.

Then, the ignition timing θig is calculated using the correction coefficient Kθ set as above by the following equation (1):

$$\theta ig = \theta \mathrm{map} \times K\theta + \theta cr \quad (1)$$

Here, the basic ignition timing θmap is determined by searching a map, not shown, according to the engine rotational speed NE and the intake pipe absolute pressure PBA, and θcr represents an amount of correction of the ignition timing, and includes a coolant temperature-dependent advance amount determined according to the engine coolant temperature, an intake air temperature-dependent advance amount determined according to the intake air temperature, and a warm-up accelerating advance amount for accelerating the warming-up of the engine at a cold start thereof.

On the other hand, when the electric throttle control device is determined to be capable of controlling the throttle valve 12 in the step S11, the correction coefficient Kθ is set to 1.0 in a step S13. That is, the ignition timing θig is set to assume the same value as the basic ignition timing that is not corrected by the correction coefficient Kθ at all. Then, the ignition timing θig is calculated by the equation (1) in a step S14.

Then, the drive signal based on the calculated ignition timing θig is delivered to the distributor 14, thereby controlling the ignition timing of the engine 10, followed by terminating the present program.

Figure 6:
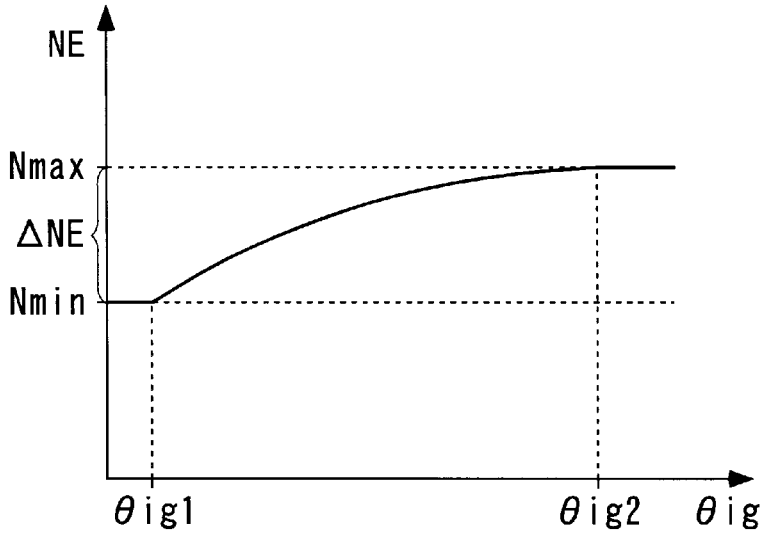
FIG. 6 is a diagram showing the relationship between the ignition timing determined by the FIG. 4 power output control process and engine rotational speed.

FIG. 6 shows the relationship between the ignition timing θig calculated by the power output control process described above when the electric throttle control device is incapable of controlling the throttle valve 2 and the throttle valve 12 is held at the default opening, and the engine rotational speed NE.

During the refuge running, when the accelerator pedal opening AP is equal to or higher than the second predetermined value AP2, the correction coefficient Kθ is set to 1.0, whereby the ignition timing θig is set to a second predetermined value (calculated value) θig2 which is most advanced, so that the engine rotational speed NE is controlled to the maximum rotational speed Nmax (e.g. 3000 rpm) for the refuge running. This maximum rotational speed Nmax enables the vehicle to travel at a speed of 50 km/h. Further, when the accelerator pedal opening AP is equal to or lower than the first predetermined value AP1, the correction coefficient Kθ is set to the predetermined value Kθ1, which is smallest, whereby the ignition timing θig is set to a first predetermined value (calculated value) θig1, which is most retarded, to control the engine rotational speed NE to a lowest rotational speed Nmin (e.g. 2000 rpm) or in its vicinity. The above control enables the default opening of the throttle valve 2 to be set to a value larger than that of the prior art by a degree corresponding to the difference ΔNE between the values Nmax and Nmin, ensuring that a larger amount of intake air is supplied to the engine during refuge running.

Further, when the accelerator pedal opening AP is between the first predetermined value AP1 and the second predetermined value AP2, the ignition timing θig is set to a value between the values θig1 and θig2 by correction of the correction coefficient Kθ, whereby the engine rotational speed NE is controlled to a value between the values Nmin and Nmax.

As described above, according to the present embodiment of the power output control system, when the electric throttle control device is determined to be incapable of controlling the throttle valve 2, the ECU 12 interrupts the energization of the DC motor 1, and the throttle valve opening TH is held at the default opening degree by the spring 4, thereby enabling the vehicle to perform refuge running to find a nearby place to park. Further, the ignition timing θig is corrected by the correction coefficient Kθ which is set according to the accelerator pedal opening AP, as described above. This makes it possible to obtain the power output from the engine according to the user's demand during the refuge running, and at the same time, the default opening of the throttle valve 2 can be set to be larger than in the prior art, which enable the vehicle to attain excellent running performance during the refuge running.

It is further understood by those skilled in the art that the foregoing is a preferred embodiment of the invention, and that various changes and modifications may be made without departing from the spirit and scope thereof.

What is claimed is:

1. A power output control system for an internal combustion engine including an electric throttle control device for electrically controlling a throttle valve that controls an amount of intake air to be supplied to the engine, and an accelerator pedal, the power output control system comprising:

uncontrollability-determining means for determining whether or not the electric throttle control device is in a condition incapable of controlling the throttle valve;

energization-interrupting means for interrupting energization of the electric throttle control device when it is determined by said uncontrollability-determining means that the electric throttle control device is in the condition incapable of controlling the throttle valve;

default opening-holding means for holding a degree of opening of the throttle valve at a default opening degree when the electric throttle control device is determined to be in the condition incapable of controlling the throttle valve;

rotational speed-detecting means for detecting a rotational speed of the engine;

load-detecting means for detecting load on the engine;

basic ignition timing-calculating means for calculating basic ignition timing according to the rotational speed detected by said rotational speed-detecting means and the load on the engine detected by said load-detecting means;

accelerator pedal operation amount-detecting means for detecting an amount of operation of the accelerator pedal; and ignition timing-determining means for determining ignition timing of the engine by correcting the basic ignition timing according to the detected amount of operation of the accelerator pedal when the electric throttle control device is determined to be in the condition incapable of controlling the throttle valve.

2. A power output control system according to claim 1, wherein said ignition timing-determining means determines the ignition timing by correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

3. A power output control system for an internal combustion engine including an electric throttle control device for electrically controlling a throttle valve that controls an amount of intake air to be supplied to the engine, and an accelerator pedal, the power output control system comprising:

an uncontrollability-determining module for determining whether or not the electric throttle control device is in a condition incapable of controlling the throttle valve;

an energization-interrupting module for interrupting energization of the electric throttle control device when it is determined by said uncontrollability-determining module that the electric throttle control device is in the condition incapable of controlling the throttle valve;

a default opening-holding module for holding a degree of opening of the throttle valve at a default opening degree when the electric throttle control device is determined to be in the condition incapable of controlling the throttle valve;

a rotational speed-detecting module for detecting a rotational speed of the engine;

a load-detecting module for detecting load on the engine;

a basic ignition timing-calculating module for calculating basic ignition timing according to the rotational speed detected by said rotational speed-detecting module and the load on the engine detected by said load-detecting means;

an accelerator pedal operation amount-detecting module for detecting an amount of operation of the accelerator pedal; and an ignition timing-determining module for determining ignition timing of the engine by correcting the basic ignition timing according to the detected amount of operation of the accelerator pedal when the electric throttle control device is determined to be in the condition incapable of controlling the throttle valve.

4. A power output control system according to claim 3, wherein said ignition timing-determining module determines the ignition timing by correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

5. A power output control method for controlling power output of an internal combustion engine including an electric throttle control device for electrically controlling a throttle valve that controls an amount of intake air to be supplied to the engine, and an accelerator pedal, the power output control method comprising the steps of:

determining whether or not the electric throttle control device is in a condition incapable of controlling the throttle valve;

interrupting energization of the electric throttle control device when it is determined that the electric throttle control device is in the condition incapable of controlling the throttle valve;

holding a degree of opening of the throttle valve at a default opening degree when the electric throttle control device is determined to be in the condition incapable of controlling the throttle valve;

detecting a rotational speed of the engine;

detecting load on the engine;

calculating basic ignition timing according to the detected rotational speed and the detected load on the engine;

detecting an amount of operation of the accelerator pedal; and determining ignition timing of the engine by correcting the basic ignition timing according to the detected amount of operation of the accelerator pedal when the electric throttle control device is determined to be in the condition incapable of controlling the throttle valve.

6. A power output control method according to claim 5, wherein the step of determining the ignition timing includes correcting the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

7. An engine control unit including a control program for causing a computer to control power output of an internal combustion engine including an electric throttle control device for electrically controlling a throttle valve that controls an amount of intake air to be supplied to the engine, and an acceleration pedal, wherein the control program causes the computer to determine whether or not the electric throttle control device is in a condition incapable of controlling the throttle valve, interrupt energization of the electric throttle control device when it is determined that the electric throttle control device is in the condition incapable of controlling the throttle valve, hold a degree of opening of the throttle valve at a default opening degree when the electric throttle control device is determined to be in the condition incapable of controlling the throttle valve, detect a rotational speed of the engine, detect load on the engine, calculate basic ignition timing according to the detected rotational speed and the detected load on the engine, detect an amount of operation of the accelerator pedal, and determine ignition timing of the engine by correcting the basic ignition timing according to the detected amount of operation of the accelerator pedal when the electric throttle control device is determined to be in the condition incapable of controlling the throttle valve.

8. An engine control unit to claim 7, wherein when the program causes the computer to correct the basic ignition timing such that the ignition timing is retarded by a largest amount when the amount of operation of the accelerator pedal is equal to or smaller than a predetermined value, and as the amount of operation of the accelerator pedal becomes larger than the predetermined value, the ignition timing becomes closer to the basic ignition timing.

* * * * *